US011373801B2

(12) United States Patent
Sparbert et al.

(10) Patent No.: US 11,373,801 B2
(45) Date of Patent: Jun. 28, 2022

(54) DEVICE FOR THE CONTACTLESS TRANSMISSION OF DATA AND OF ENERGY AND FOR ANGLE MEASUREMENT

(71) Applicant: Robert Bosch GmbH, Stuttgart (DE)

(72) Inventors: Jan Sparbert, Rutesheim (DE); Horst Beling, Heilbronn (DE); Timo Knecht, Mundelsheim (DE)

(73) Assignee: Robert Bosch GmbH, Stuttgart (DE)

( * ) Notice: Subject to any disclaimer, the term of this patent is extended or adjusted under 35 U.S.C. 154(b) by 225 days.

(21) Appl. No.: 16/753,210

(22) PCT Filed: Oct. 8, 2018

(86) PCT No.: PCT/EP2018/077319
§ 371 (c)(1),
(2) Date: Apr. 2, 2020

(87) PCT Pub. No.: WO2019/076665
PCT Pub. Date: Apr. 25, 2019

(65) Prior Publication Data

US 2020/0294714 A1 Sep. 17, 2020

(30) Foreign Application Priority Data

Oct. 19, 2017 (DE) ..... 102017218676.3

(51) Int. Cl.
*H01F 38/18* (2006.01)
*H01F 38/14* (2006.01)

(52) U.S. Cl.
CPC ..... *H01F 38/18* (2013.01); *H01F 38/14* (2013.01); *H01F 2038/143* (2013.01)

(58) Field of Classification Search
CPC .... H01F 38/18; H01F 38/14; H01F 2038/143; H01F 27/38; B62D 1/046; B60R 16/027; B60R 16/03; H02K 15/02
See application file for complete search history.

(56) References Cited

U.S. PATENT DOCUMENTS 6,512,437 B2 1/2003 Jin et al.
7,800,475 B2 9/2010 Mizutani et al.
(Continued)

FOREIGN PATENT DOCUMENTS

CN 101009156 A 8/2007
CN 205486858 U 8/2016
(Continued)

OTHER PUBLICATIONS

International Search Report for PCT/EP2018/077319, dated Dec. 12, 2018.

*Primary Examiner* — Lincoln D Donovan
*Assistant Examiner* — Alex W Lam
(74) *Attorney, Agent, or Firm* — Norton Rose Fulbright US LLP; Gerard Messina

(57) ABSTRACT

A device for contactless transmission of data and energy and for angle measurement, including a first disk-shaped unit and a second disk-shaped unit, which move in relation to one another around a shared rotational axis and are opposite to one another axially spaced apart with respect to the rotational axis. The first disk-shaped unit including a first annular disk-shaped recess, and the second disk-shaped unit including a first annular disk-shaped recess, which is opposite to the first annular disk-shaped recess of the first disk-shaped unit radially spaced apart with respect to the rotational axis. The first disk-shaped unit includes at least one second annular disk-shaped unit situated concentrically to the first annular disk-shaped recess of the first disk-shaped unit, and the second disk-shaped unit includes at least one second annular disk-shaped recess situated concentrically to the first annular disk-shaped recess of the second disk-shaped unit.

11 Claims, 2 Drawing Sheets

(56) References Cited

U.S. PATENT DOCUMENTS

| | | | | |
|---|---|---|---|---|
| 2002/0057164 | A1* | 5/2002 | Jin | H01F 38/14<br>336/115 |
| 2014/0307856 | A1 | 10/2014 | Luthardt et al. | |

FOREIGN PATENT DOCUMENTS

| | | | |
|---|---|---|---|
| DE | 19859557 | A1 | 7/1999 |
| DE | 102004028595 | A1 | 12/2005 |
| DE | 102015103823 | A1 | 9/2016 |
| EP | 1050437 | A2 | 11/2000 |
| WO | 2016121055 | A1 | 8/2016 |

* cited by examiner

DEVICE FOR THE CONTACTLESS TRANSMISSION OF DATA AND OF ENERGY AND FOR ANGLE MEASUREMENT

FIELD

The present invention relates to a device for the contactless transmission of data and of energy and for angle measurement. The present invention furthermore relates to a LIDAR sensor including a device according to the present invention.

BACKGROUND INFORMATION

A device for the transmission of data and energy between two objects moving in relation to one another around a shared rotational axis is described in German Patent Application No. DE 10 2015 103 823 A1. The objects each include coils, which are opposite to one another axially spaced apart with respect to the rotational axis in such a way that an energy transmission is possible by inductive coupling between the coils. A particular electrode carrier including a particular electrical conductor is provided coaxially and rotatably fixed with respect to the particular coils, the electrode carriers opposing one another axially spaced apart and the electrical conductors being situated in such a way that a data transmission is possible by electrical coupling between the electrical conductors. An arrangement at the conductive material for shielding is provided in each case between the first coil and the electrical conductor coaxial thereto and/or between the second coil and the electrical conductor coaxial thereto.

SUMMARY

The present invention is directed to a device for the contactless transmission of data and energy and for angle measurement. An example device in accordance with the present invention includes a first disk-shaped unit and a second disk-shaped unit, which move in relation to one another around a shared rotational axis and are opposite to one another axially spaced apart with respect to the rotational axis. In this case, the first disk-shaped unit includes a first annular disk-shaped recess. In this case, the second disk-shaped unit includes a first annular disk-shaped recess, which is opposite to the first annular disk-shaped recess of the first disk-shaped unit radially spaced apart with respect to the rotational axis.

According to the present invention, the first disk-shaped unit includes at least one second annular disk-shaped recess situated concentrically to the first annular disk-shaped recess of the first disk-shaped unit. Furthermore, the second disk-shaped unit includes at least one second annular disk-shaped recess situated concentrically to the first annular disk-shaped recess of the second disk-shaped unit.

The circumference and the surface area of the first disk-shaped unit may be predefined by the radius of the first disk-shaped unit. The circumference and the surface area of the second disk-shaped unit may be predefined by the radius of the second disk-shaped unit. The radius of the first disk-shaped unit may be equal to the radius of the second disk-shaped unit.

Both the first annular disk-shaped recess and the at least one second annular disk-shaped recess of the first disk-shaped unit may each be represented as an annulus, which is delimited in each case by an outer ring and an inner ring, in a top view along the rotational axis on the first disk-shaped unit. The rotational axis may be situated in the center point of the first disk-shaped unit. The rotational axis may be situated in the center point of the first annular disk-shaped recess and in the center point of the at least one second annular disk-shaped recess. Therefore, both the first annular disk-shaped recess and the at least one second annular disk-shaped recess may each have a uniform distance to the rotational axis of the device. The properties explained for the first disk-shaped unit and its first annular disk-shaped recess and it is at least one second annular disk-shaped recess may apply similarly to the second disk-shaped unit.

That the first annular disk-shaped recess of the first disk-shaped unit and the first annular disk-shaped recess of the second disk-shaped unit are opposite to one another radially spaced apart may be understood to mean that both have the same distance to the rotational axis of the device. In this case, in particular the distance of the outer ring of the first annular disk-shaped recess of the first disk-shaped unit may be equal to the distance of the outer ring of the first annular disk-shaped recess of the second disk-shaped unit. In particular, the distance of the inner ring of the first annular disk-shaped recess of the first disk-shaped unit may be equal to the distance of the inner ring of the first annular disk-shaped recess of the second disk-shaped unit. The annular breadth of the first annular disk-shaped recess of the first disk-shaped unit may be essentially exactly equal to the annular breadth of the first annular disk-shaped recess of the second disk-shaped unit. The distance of the outer ring and the inner ring of the first annular disk-shaped recess of the first disk-shaped unit may be equal to the distance of the outer ring and the inner ring of the first annular disk-shaped recess of the second disk-shaped unit.

An advantage of the present invention is that the device enables the modular arrangement of further components in the first and/or second annular disk-shaped recess of the first disk-shaped unit. Furthermore, a modular arrangement of further components of the device in the first and/or second annular disk-shaped recess of the second disk-shaped unit is enabled. The precise structure of the device may thus be flexibly designed.

In one advantageous embodiment of the present invention, it is provided that the at least one second annular disk-shaped recess of the first disk-shaped unit is opposite to the at least one second annular disk-shaped recess of the second disk-shaped unit radially spaced apart with respect to the rotational axis.

That the at least one second annular disk-shaped recess of the first disk-shaped unit and the at least one second annular disk-shaped recess of the second disk-shaped unit are opposite to one another radially spaced apart may be understood to mean that both have an equal distance to the rotational axis of the device. In this case, in particular the distance of the outer ring of the at least one second annular disk-shaped recess of the first disk-shaped unit may be equal to the distance of the outer ring of the at least one second annular disk-shaped recess of the second disk-shaped unit. In particular, the distance of the inner ring of the at least one second annular disk-shaped recess of the first disk-shaped unit may be equal to the distance of the inner ring of the at least one second annular disk-shaped recess of the second disk-shaped unit. The annular breadth of the at least one second annular disk-shaped recess of the first disk-shaped unit may be essentially exactly equal to the annular breadth of the at least one second annular disk-shaped recess of the second disk-shaped unit. The distance of the outer ring and the inner ring of the at least one second annular disk-shaped recess of the first disk-shaped unit may be equal to the distance of the outer ring and the inner ring of the at least one second annular disk-shaped recess of the second disk-shaped unit.

The advantage of this example embodiment is that components of the device which are situated in the at least one second annular disk-shaped recess of the first disk-shaped unit and components of the device which are situated in the at least one second annular disk-shaped recess of the second disk-shaped unit may be precisely opposite to one another. In this way, a data transmission and/or an energy transmission and/or an angle measurement may be carried out with high accuracy.

In another advantageous embodiment of the present invention, it is provided that the first disk-shaped unit is constructed in one piece; and/or the second disk-shaped unit is constructed in one piece.

An advantage of this embodiment is that the first disk-shaped unit and/or the second disk-shaped unit are constructed very robustly.

In another advantageous embodiment of the present invention, it is provided that the first disk-shaped unit is made up of a magnetic material, in particular ferrite; and/or the second disk-shaped unit is made up of a magnetic material, in particular ferrite.

An advantage of this embodiment is that magnetic materials, in particular ferrite, may be processed simply and cost-effectively. Thus, the first disk-shaped unit and/or the second disk-shaped unit of the above-described complexity may be manufactured easily from ferrite. Due to their rotational symmetry, hard ferrites may be turned easily. Other ferrite composites, for example, including ferrite particles and a suitable bonding material, may be molded in injection technology. Components of the device which are situated in the first annular disk-shaped recess and/or the at least one second annular disk-shaped recess of one of the disk-shaped units are magnetically isolated from one another.

In another advantageous embodiment of the present invention, it is provided that the first disk-shaped unit and the second disk-shaped unit are situated spaced apart in relation to one another in such a way that an air gap is located between the first disk-shaped unit and the second disk-shaped unit.

An advantage of this embodiment is that the first disk-shaped unit and the second disk-shaped unit may be moved in relation to one another around the shared rotational axis without large friction losses.

In another advantageous embodiment of the present invention, it is provided that at least one component for energy transmission, at least one component for data transmission, and/or at least one component for angle measurement is situated in each case in the first and at least one second annular disk-shaped recess of the first disk-shaped unit.

An advantage of this embodiment is that better energy transmissions, better data transmissions, and/or more accurate angle measurements are enabled by the arrangement of the components in the annular disk-shaped recess.

In another advantageous embodiment of the present invention, it is provided that at least one component for energy transmission, at least one component for data transmission, and/or at least one component for angle measurement is situated in each case in the first and at least one second annular disk-shaped recess of the second disk-shaped unit.

An advantage of this embodiment is that better energy transmissions, better data transmissions, and/or more accurate angle measurements are enabled by the arrangement of the components in the annular disk-shaped recess.

In another advantageous embodiment of the present invention, it is provided that the at least one component for energy transmission of the first disk-shaped unit is opposite to the at least one component for energy transmission of the second disk-shaped unit radially spaced apart with respect to the rotational axis; and/or the at least one component for data transmission of the first disk-shaped unit is opposite to the at least one component for data transmission of the second disk-shaped unit radially spaced apart with respect to the rotational axis; and/or the at least one component for angle measurement of the first disk-shaped unit is opposite to the at least one component for angle measurement of the second disk-shaped unit radially spaced apart with respect to the rotational axis.

An advantage of this embodiment is that components associated with one another are situated in spatial proximity in relation to one another. Therefore, energy transmissions, data transmissions, and/or angle measurements may be carried out more accurately and efficiently.

In another advantageous embodiment of the present invention, it is provided that the at least one component for data transmission of the first disk-shaped unit is situated in the annular disk-shaped recess of the first disk-shaped unit which has the smallest radial distance to the rotational axis.

An advantage of this embodiment is that in this way the components which require little space and power consumption have the smallest distance to the rotational axis.

In another advantageous embodiment of the present invention, it is provided that the at least one component for angle measurement of the first disk-shaped unit is situated in the annular disk-shaped recess of the first disk-shaped unit which has the greatest radial distance to the rotational axis.

An advantage of this embodiment is that the accuracy of the angle measurement may be increased. The accuracy of the angle measurement increases with the distance to the rotational axis.

In another advantageous embodiment of the present invention, it is provided that the at least one component for energy transmission of the first disk-shaped unit is situated in the annular disk-shaped recess of the first disk-shaped unit, which has an average radial distance to the rotational axis, lying between the smallest radial distance to the rotational axis and the greatest radial distance to the rotational axis.

An advantage of this embodiment is that the energy transmission may be carried out with higher reliability and efficiency. In the case of the energy transmission, it is advantageous if the transmittable energy or power (in watts) is transmitted with high efficiency (net power). The transmittable energy as such and the efficiency of the transmission are dependent on the diameter of the disk-shaped unit and on the radial distance of the disk-shaped unit to the rotational axis. An average distance may be very suitable in this case. In comparison to the component for data transmission, a greater distance to the rotational axis is advantageous for a component for energy transmission.

In another advantageous embodiment of the present invention, it is provided that the first disk-shaped unit includes a recess along the rotational axis; and/or the second disk-shaped unit includes a recess along the rotational axis; and in particular an electric motor for generating a relative movement of the first disk-shaped unit and the second disk-shaped unit in relation to one another is situated in the recess of the first disk-shaped unit and/or in the recess of the second disk-shaped unit.

An advantage of this embodiment is that the structural form of the device may be kept flat.

The present invention furthermore relates to a LIDAR sensor including a device according to the present invention for contactless transmission of data and energy and for angle measurement.

BRIEF DESCRIPTION OF THE DRAWINGS

An exemplary embodiment of the present invention is explained in greater detail hereafter on the basis of the figures. Identical reference numerals in the figures identify identical or identically acting elements.

DETAILED DESCRIPTION OF EXAMPLE EMBODIMENTS

Figure 1:
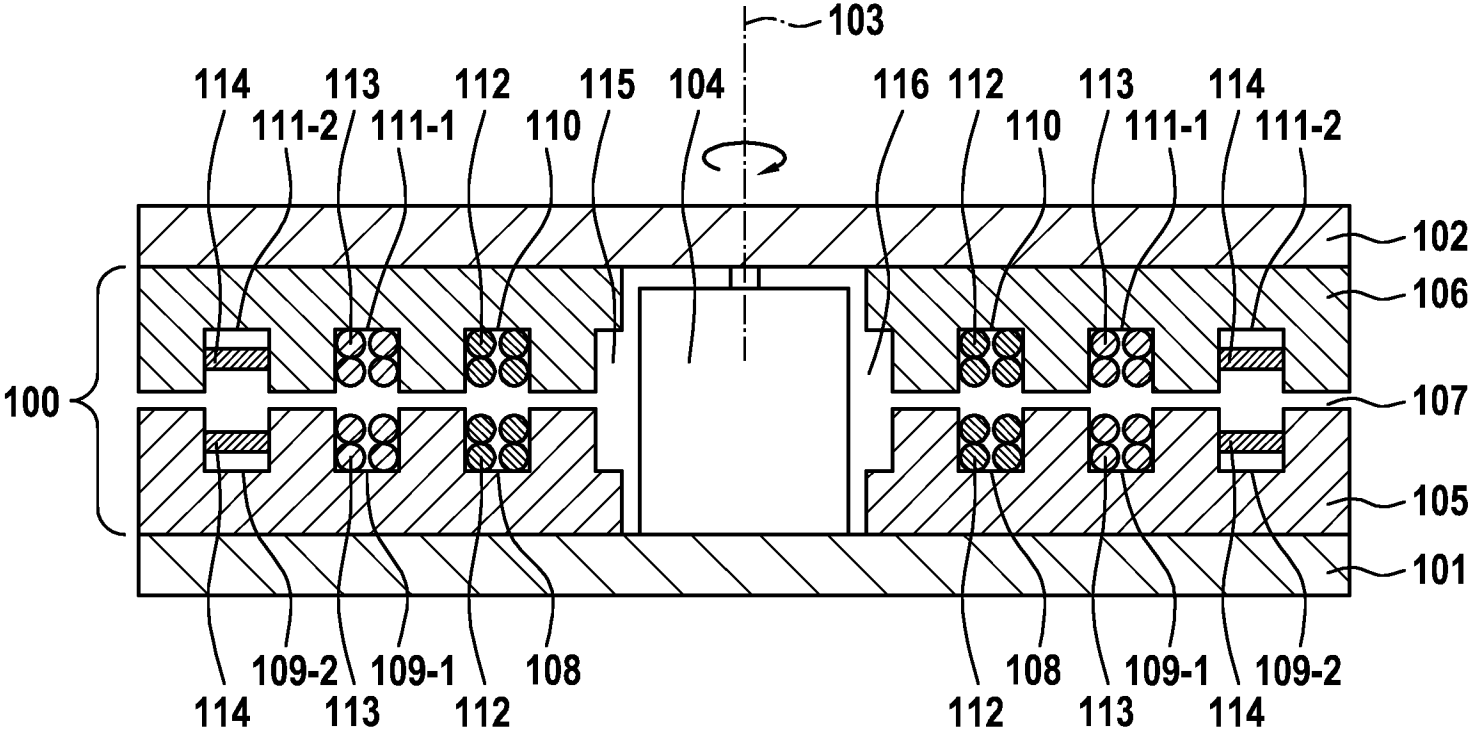
FIG. 1 shows a side view of a device according to the present invention.

FIG. 1 shows device 100 in a side view by way of example. Device 100 may be part of a LIDAR sensor, for example, which may include a stator 101 and a rotor 102 as shown. In this way, a unit rotatable around rotational axis 103 results. First disk-shaped unit 105 may be situated on stator 101. First disk-shaped unit 105 is constructed in one piece in the example shown. First disk-shaped unit 105 may be made up of a magnetic material, in particular ferrite. Second disk-shaped unit 106 may be situated on rotor 102. Second disk-shaped unit 106 is constructed in one piece in the example shown. Second disk-shaped unit 106 may be made up of a magnetic material, in particular ferrite. First disk-shaped unit 105 and second disk-shaped unit 106 are opposite to one another with axial spacing with respect to rotational axis 103. First disk-shaped unit 105 and second disk-shaped unit 106 may move in relation to one another around shared rotational axis 103. Air gap 107 is located between first disk-shaped unit 105 and second disk-shaped unit 106. First disk-shaped unit 105 includes a recess 115 along rotational axis 103. Second disk-shaped unit 106 includes a recess 116 along rotational axis 103. An electric motor 104 for generating a relative movement of first disk-shaped unit 105 and second disk-shaped unit 106 in relation to one another is situated in recess 115 and in recess 116. First disk-shaped unit 105 and second disk-shaped unit 106 may be constructed identically or, identically except for recesses 115 and 116.

First disk-shaped unit 105 and second disk-shaped unit 106 each include three annular disk-shaped recesses in the example shown. Each annular disk-shaped recess may be seen twice due to the side view of device 100. First disk-shaped unit 105 includes a first annular disk-shaped recess 108 and the two second annular disk-shaped recesses 109-1 and 109-2, which are each situated concentrically in relation to first annular disk-shaped recess 108. Second disk-shaped unit 106 includes a first annular disk-shaped recess 110 and two second annular disk-shaped recesses 111-1 and 111-2, which are each situated concentrically in relation to first annular disk-shaped recess 110.

Figure 2:
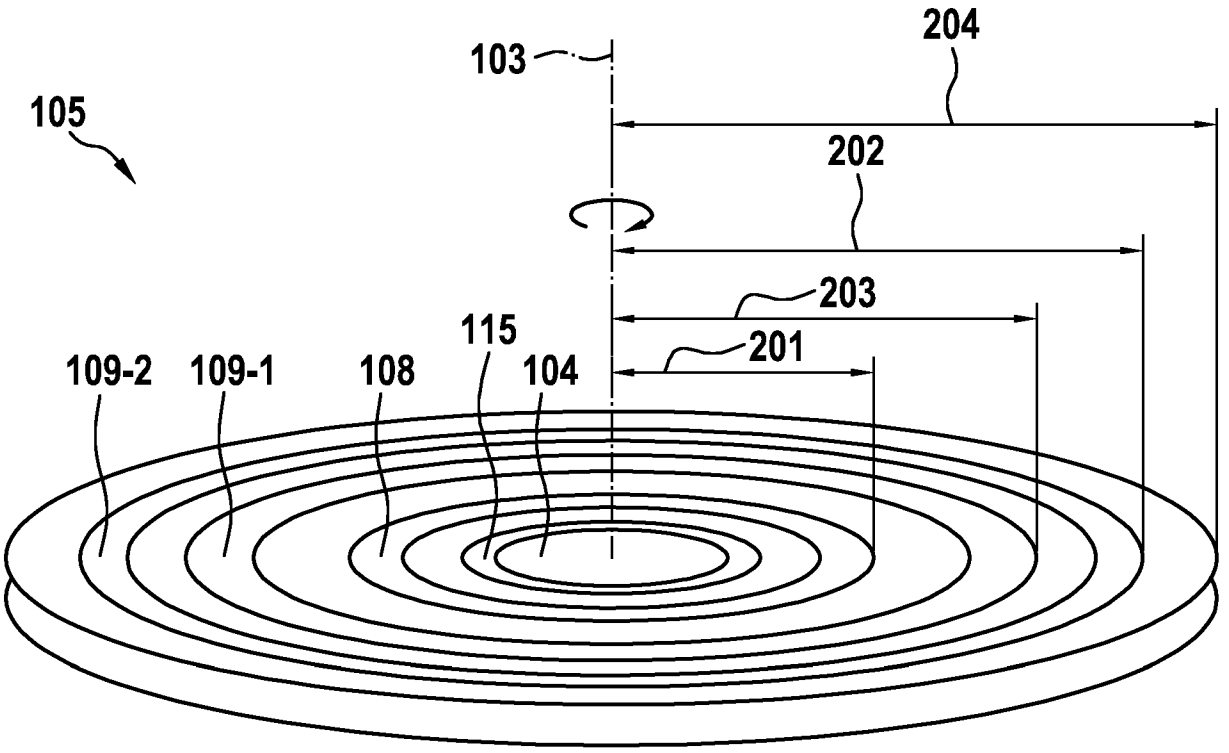
FIG. 2 shows the view of a disk-shaped unit of the device diagonally from above.

FIG. 2 shows the view of disk-shaped unit 105 of device 100 diagonally from above. Disk-shaped unit 105 has radius 204. Recess 115 of disk-shaped unit 105, in which motor 104 is situated, is again visible from this perspective. Disk-shaped unit 105 is designed to be rotatable around rotational axis 103. Furthermore, first annular disk-shaped recess 108 and two second annular disk-shaped recesses 109-1 and 109-2 of disk-shaped unit 105 are also apparent. In this case, first annular disk-shaped recess 108 has smallest radial distance 201 to rotational axis 103. Distance 201 of the outer ring of first annular disk-shaped recess 108 is plotted purely by way of example in this case. The one second annular disk-shaped recess 109-2 has greatest radial distance 202 to rotational axis 103. Distance 202 of the outer ring of annular disk-shaped recess 109-2 is also plotted here purely by way of example. Other second annular disk-shaped recess 109-1 has an average distance 203 to rotational axis 103. Average distance 203 lies between smallest radial distance 201 of annular disk-shaped recess 108 and greatest radial distance 202 of second annular disk-shaped recess 109-2. Distance 203 of the outer ring of annular disk-shaped recess 109-1 is also plotted here purely by way of example.

As is apparent from FIG. 1, an identical image would result in a view of second disk-shaped unit 106 of device 100 diagonally from above. First annular disk-shaped recess 110 of second disk-shaped unit 106 has the smallest radial distance to rotational axis 103. As is apparent, first annular disk-shaped recess 110 of second disk-shaped unit 106 has the identical radial distance to rotational axis 103 as first annular disk-shaped recess 108 of first disk-shaped unit 105. First annular disk-shaped recess 108 of first disk-shaped unit 105 is opposite to first annular disk-shaped recess 110 of second disk-shaped unit 106 radially spaced apart with respect to the rotational axis.

The one second annular disk-shaped recess 111-2 has the greatest radial distance to rotational axis 103. As is apparent, the one second annular disk-shaped recess 111-2 of second disk-shaped unit 106 has the identical radial distance to rotational axis 103 as the one second annular disk-shaped recess 109-2 of first disk-shaped unit 105. The one second annular disk-shaped recess 109-2 of first disk-shaped unit 105 is opposite to the one second annular disk-shaped recess 111-2 of second disk-shaped unit 106 radially spaced apart with respect to the rotational axis.

Other second annular disk-shaped recess 111-1 has an average radial distance to rotational axis 103. As is apparent, other second annular disk-shaped recess 111-1 of second disk-shaped unit 106 has the identical radial distance to rotational axis 103 as other second annular disk-shaped recess 109-1 of first disk-shaped unit 105. Second annular disk-shaped recess 109-1 of first disk-shaped unit 105 is opposite to second annular disk-shaped recess 111-1 of second disk-shaped unit 106 radially spaced apart with respect to the rotational axis.

It is furthermore apparent in FIG. 1 that further components are situated both in annular disk-shaped recesses 108, 109-1, and 109-2 of first disk-shaped unit 105 and in annular disk-shaped recesses 110, 111-1, and 111-2 of second disk-shaped unit 106. These may each be at least one component for energy transmission 113, at least one component for data transmission 112, and/or at least one component for angle measurement 114. Each component may be made inductive and/or magnetic.

As shown in the example, it is particularly advantageous if the at least one component for data transmission 112 is situated in first annular disk-shaped recess 108 of first disk-shaped unit 105 and/or in first annular disk-shaped recess 110 of second disk-shaped unit 106, which each have the smallest distance to rotational axis 103. At least one component for energy transmission 113 is advantageously situated in each case in annular disk-shaped recess 109-1 of first disk-shaped unit 105 and/or in annular disk-shaped recess 111-2 of second disk-shaped unit 106, which each has an average distance to rotational axis 103. At least one component for angle measurement 114 is situated in each case in annular disk-shaped recess 109-2 of first disk-shaped unit 105 and/or in annular disk-shaped recess 111-2 of second disk-shaped unit 106, which each have the greatest distance to rotational axis 103. Components having an identical function and/or a function associated with one another are accordingly situated in first disk-shaped unit 105 and in second disk-shaped unit 106 in such a way that they are opposite to one another radially spaced apart with respect to rotational axis 103. The components having an identical function and/or a function associated with one another may be identical in this case. If the components having an identical function and/or a function associated with one another are not identical, the transmission may thus take place in both directions, both from first disk-shaped unit 105 to second disk-shaped unit 106 and from second disk-shaped unit 106 to first disk-shaped unit 105. It may be presumed for the energy transmission that it takes place from the static part into the rotating part. The components for energy transmission 113 may include one or multiple coil pairs for this purpose. The data transmission may preferably take place in both directions. The components for data transmission 112 may include identical coils or different coils. The angle measurement may either take place on the side of stator 101 or preferably on the side of rotor 102.

The components in the annular disk-shaped recesses may be connected to further components (not shown here). Such components may be component of a LIDAR sensor. These may be components for modulation of the inductive data transmission, oscillating circuits for energy transmission, active oscillating circuits, or passive components of the angle measurement. These may be active optical components with a modulation. The emitter and/or the receiver of a LIDAR sensor may be situated on the rotor and/or the stator of the LIDAR sensor. The emitter and the receiver of a LIDAR sensor may be active on one side, i.e., on the rotor or the stator, and may be a passive reflector on the other side. The disk-shaped unit may advantageously increase the mechanical stability, protect from ambient light, and/or protect from contaminants.

What is claimed is:

1. A device for contactless transmission of data and of energy and for angle measurement, comprising:

a first disk-shaped unit and a second disk-shaped unit, which move in relation to one another around a shared rotational axis and are opposite to one another axially spaced apart with respect to the rotational axis;

wherein the first disk-shaped unit includes a first annular disk-shaped recess, wherein the second disk-shaped unit including a first annular disk-shaped recess, which is opposite to the first annular disk-shaped recess of the first disk-shaped unit radially spaced apart with respect to the rotational axis, wherein the first disk-shaped unit includes at least one second annular disk-shaped unit situated concentrically to the first annular disk-shaped recess of the first disk-shaped unit, wherein the second disk-shaped unit includes at least one second annular disk-shaped recess situated concentrically to the first annular disk-shaped recess of the second disk-shaped unit, wherein at least one component for energy transmission, and/or at least one component for data transmission, and/or at least one component for angle measurement is situated in each case in the first and at least one second annular disk-shaped recess of the first disk-shaped unit, wherein the at least one component for data transmission of the first disk-shaped unit is situated in the annular disk-shaped recess of the first disk-shaped unit which has a smallest radial distance to the rotational axis, and wherein the at least one component for angle measurement of the first disk-shaped unit is situated in the annular disk-shaped recess of the first disk-shaped unit which has a greatest radial distance to the rotational axis.

2. The device as recited in claim 1, wherein the at least one second annular disk-shaped recess of the first disk-shaped unit is opposite to one of the at least one second annular disk-shaped recesses of the second disk-shaped unit radially spaced apart with respect to the rotational axis.

3. The device as recited in claim 1, wherein the first disk-shaped unit is constructed in one piece, and/or the second disk-shaped unit is constructed in one piece.

4. The device as recited in claim 1, wherein the first disk-shaped unit and/or the second disk-shaped unit is made up of a magnetic material.

5. The device as recited in claim 1, the first disk-shaped unit and/or the second disk-shaped unit is made up of ferrite.

6. The device as recited in claim 1, wherein the first disk-shaped unit and the second disk-shaped unit are situated spaced apart in relation to one another in such a way that an air gap is located between the first disk-shaped unit and the second disk-shaped unit.

7. The device as recited in claim 1, wherein at least one component for energy transmission, and/or at least one component for data transmission, and/or at least one component for angle measurement is situated in each case in the first and at least one second annular disk-shaped recess of the second disk-shaped unit.

8. The device as recited in claim 7, wherein: (i) the at least one component for energy transmission of the first disk-shaped unit is opposite to the at least one component for energy transmission of the second disk-shaped unit radially spaced apart with respect to the rotational axis, and/or (ii) the at least one component for data transmission of the first disk-shaped unit is opposite to the at least one component for data transmission of the second disk-shaped unit radially spaced apart with respect to the rotational axis, and/or (iii) the at least one component for angle measurement of the first disk-shaped unit is opposite to the at least one component for angle measurement of the second disk-shaped unit radially spaced apart with respect to the rotational axis.

9. The device as recited in claim 1, wherein the at least one component for energy transmission of the first disk-shaped unit is situated in the annular disk-shaped recess of the first disk-shaped unit, which has an average radial distance to the rotational axis, lying between the smallest radial distance to the rotational axis and the greatest radial distance to the rotational axis.

10. The device as recited in claim 1, wherein the first disk-shaped unit includes a recess along the rotational axis, and/or the second disk-shaped unit includes a recess along the rotational axis, wherein an electric motor configured to generate a relative movement of the first disk-shaped unit and the second disk-shaped unit in relation to one another is situated in the recess of the first disk-shaped unit and/or in the recess of the second disk-shaped unit.

11. A LIDAR sensor including a device for contactless transmission of data and energy and for angle measurement, comprising:

a first disk-shaped unit; and a second disk-shaped unit, wherein the first disk-shaped unit and the second disk-shaped unit move in relation to one another around a shared rotational axis and are opposite to one another axially spaced apart with respect to the rotational axis;

wherein the first disk-shaped unit includes a first annular disk-shaped recess, wherein the second disk-shaped unit including a first annular disk-shaped recess, which is opposite to the first annular disk-shaped recess of the first disk-shaped unit radially spaced apart with respect to the rotational axis, wherein the first disk-shaped unit includes at least one second annular disk-shaped unit situated concentrically to the first annular disk-shaped recess of the first disk-shaped unit, and wherein the second disk-shaped unit includes at least one second annular disk-shaped recess situated concentrically to the first annular disk-shaped recess of the second disk-shaped unit, wherein at least one component for energy transmission, and/or at least one component for data transmission, and/or at least one component for angle measurement is situated in each case in the first and at least one second annular disk-shaped recess of the first disk-shaped unit, wherein the at least one component for data transmission of the first disk-shaped unit is situated in the annular disk-shaped recess of the first disk-shaped unit which has a smallest radial distance to the rotational axis, and wherein the at least one component for angle measurement of the first disk-shaped unit is situated in the annular disk-shaped recess of the first disk-shaped unit which has a greatest radial distance to the rotational axis.

* * * * *